US005333659A

United States Patent [19]

Carpenter et al.

[11] Patent Number: 5,333,659

[45] Date of Patent: Aug. 2, 1994

[54] KNIFE HOLDER

[75] Inventors: Charles T. Carpenter; Robert M. Bayly, both of Lake Oswego, Oreg.

[73] Assignee: Key Knife, Inc., Portland, Oreg.

[21] Appl. No.: 94,240

[22] Filed: Jul. 21, 1993

[51] Int. Cl.[5] ..... B27G 13/00; B26D 1/12

[52] U.S. Cl. ..... 144/231; 144/218; 144/229; 144/241; 144/162 R; 407/2; 407/46; 407/101

[58] Field of Search ..... 144/162 R, 172, 174, 144/218, 229, 230, 231, 237, 238, 241; 407/2, 5, 6, 31, 37, 41, 45, 46, 56, 58, 83, 101, 104

[56] References Cited

U.S. PATENT DOCUMENTS

| | | | |
|---|---|---|---|
| 3,487,865 | 1/1970 | Chapman et al. | 144/237 |
| 3,775,817 | 12/1973 | Wentel | 407/46 |
| 3,817,305 | 6/1974 | Gibbs | 144/231 |
| 3,838,724 | 10/1974 | Buchacher et al. | 144/230 |
| 3,957,094 | 5/1976 | Maier | 144/230 |
| 4,151,869 | 5/1979 | Halloran et al. | 144/230 |
| 4,396,315 | 8/1983 | Middleton | 144/231 |
| 4,997,018 | 3/1991 | Carpenter et al. | 144/241 |
| 5,146,963 | 9/1992 | Carpenter et al. . | |

*Primary Examiner*—W. Donald Bray
*Attorney, Agent, or Firm*—Kolisch, Hartwell, Dickinson, McCormack & Heuser

[57] ABSTRACT

A chipping cutter head including a double-edged knife and support structure mounting the knife in a pocket provided at the periphery of a cutter head body. The support structure includes a block member fastened by screws to the floor of the pocket. Adjustment structure is provided for adjusting the position of the block member, with this being effective to shift the position of the cutting edge of a knife supported on the block member. A replaceable insert member with a wear surface is positioned by a pin on the block member, and this insert member supports the knife and the knife is locked from shifting axially on the insert member.

12 Claims, 2 Drawing Sheets

KNIFE HOLDER

BACKGROUND AND SUMMARY OF THE INVENTION

This invention relates to what is known as a chipping cutter head, sometimes referred to as chipping canter. A cutter head of this description is usable to remove, in the form of chips, material cut from an article such as a log to produce a cant from the log. The usual cutter head includes a body with shaft extensions extending from opposite ends of the body. The cutter head is rotatable about the axis of these extensions. Cutting elements or knives are distributed about the circumference of the cutter head body, and these cut chips in a planing type action from the wood material being processed.

A conventional type of chipping cutter head known in the past has included what might be described as cavities distributed about the circumference of the body in the cutter head. Knife bodies are detachably mounted within these cavities, and these knife bodies are provided with sharp knife edges that move in circumferential sweeps with rotation of the cutter head to produce the cutting action. The knife body must periodically be removed for sharpening purposes and after sharpening it is returned to its respective cavity. For the knife bodies to be properly mounted with their cutting edges positioned to produce the type of cutting action desired, babbitting or shimming of the body is performed, which is effective to adjust the position of the body and the cutting edge which the body includes. With a great many knife bodies ordinarily making up a cutter head, the procedure outlined obviously is a time consuming one, requiring skill and experience.

More recently there has been developed a cutter head which has included replaceable, doubled-edged knife elements or knives suitably distributed about the periphery of a cutter head body. When one edge of the knife element is dull, it is turned on itself to expose its other cutting edge. When both of its cutting edges are dulled, the knife element is replaced by a new knife element. Clamp structure is provided which releasably holds a knife element in a proper position. A cutter head with knives of this description is disclosed in our prior issued U.S. Pat. No. 5,146,963 entitled "CHIPPING DEVICE" issuing Sep. 15, 1992.

While a chipping cutter head as set forth in the aforementioned patent has been demonstrated to have substantial advantages over cutter heads with knife bodies that are removed and resharpened to be returned on dulling, in certain applications it has been found desirable to include additional structure in the cutter head functioning accurately to position a knife in the cutter head, and firmly to establish its position even after being subjected to frequent and substantial jarring and shocks as is common with a chipping cutter head. This invention addresses the problem of mounting a knife or knife element so that it is securely held in an established position on the cutter head.

The invention further addresses the problem of providing a wear surface for each of respective knives in a cutter head, where the wear surface is part of a replaceable mounting insert, which is easily replaced when mandated by wear occurring in an installed insert, or should a differently shaped wear surface be desired for the purpose of producing a different size and type of chip. The mounting insert, while detachable and replaceable, is incorporated in the support structure for the knife in such manner that the insert is positively mechanically held from displacement during use of the cutter head.

Also a feature of the invention is the provision of a chipping cutter head which incorporates in a novel fashion a removable splitter element which functions to split chips produced with the knife of a cutter head. Further explaining, with certain species of wood, and under certain temperature conditions, chips produced by a cutter head may have a greater size than the optimum size desired. A splitter element incorporated with the cutter head splits chips cut by the cutter head to reduce their size. While splitting may be desirable with a pine species, under certain temperature conditions with other species, or with frozen wood, splitting may not be necessary. With the construction contemplated by the invention, a splitter element is easily incorporated into the cutter head for association with each knife in the cutter head. The cutter head may be run with or without the splitter elements, and the splitter elements are easily changed or removed without making a change in knife setting.

BRIEF DESCRIPTION OF THE DRAWINGS

These and various other objects and advantages are obtained by the invention, which is described more fully below, with the description to be taken in conjunction with the accompanying drawings, wherein.

DETAILED DESCRIPTION OF A PREFERRED EMBODIMENT

Figure 1:
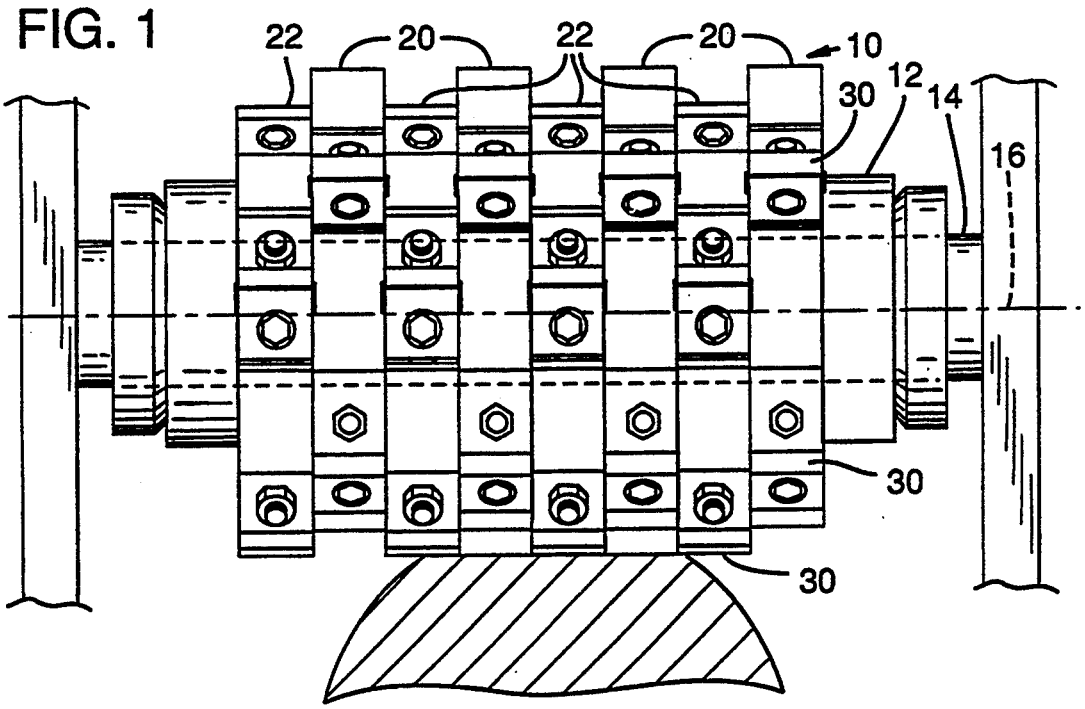
FIG. 1 is a side view of a chipping cutter head constructed according to the present invention.

Referring now to the drawings, a cutter head pursuant to the invention is indicated generally at 10. The cutter head includes what is referred to herein as a cutter head body 12, and a shaft 14 to which the body is keyed whereby the shaft and body rotate together. The ends of the shaft are also referred to herein as shaft extensions, and these project outwardly from opposite ends of the cutter head body. During use, the cutter head is rotated about the axis of the shaft, which shown at 16.

The cutter head body is formed of multiple spindle segments 20, interspersed with multiple spindle segments 22. The spindle segments may all have the same construction, so only one will be described in detail.

Figure 3:
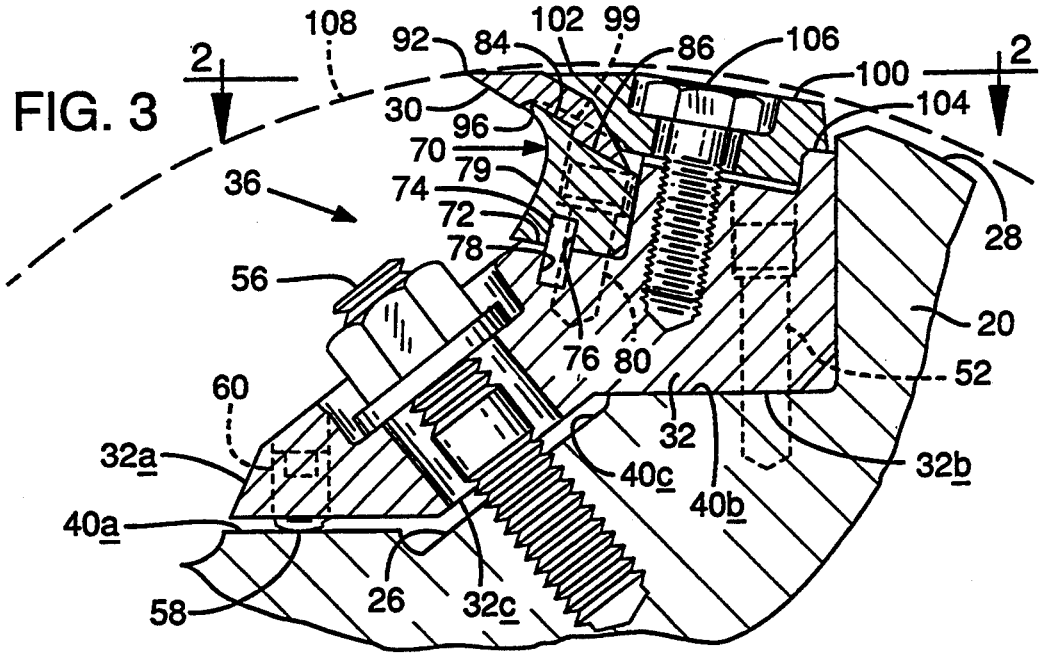
FIG. 3 is a cross sectional, view taken generally along the line 3—3 in FIG. 2.

Specifically, each spindle segment includes plural recessed portions or pockets, such as the one indicated generally at 26 in FIG. 3. These are equally circumferentially distributed about the circumference of the spindle segment. Separating each pocket in a segment from the one which follows it is a projecting portion, such as projecting portion 28 illustrated in FIG. 3.

The spindle segments are mounted on shaft 14, with one series of segments, i.e. segments 20, positioned so that the pockets in the segments are mutually aligned, and with the other series of segments, i.e. segments 22, positioned with the pockets on these segments mutually aligned. In the construction being described, there are three pockets, exemplified by pocket 26 shown in FIG. 3, equally circumferentially distributed about each spindle segment. With the various spindle segments having three pockets distributed about their periphery, a circumferential offset of 60 degrees between the segments of one series and the segments of the other series is present. This results in the projecting portions of one series of segments being spaced in a circumferential direction midway between the projecting portions of the other series.

Disposed within each pocket of a spindle segment is a knife element 30 and support structure 36 for the knife supporting the knife on the cutter head body 12.

Figure 2:
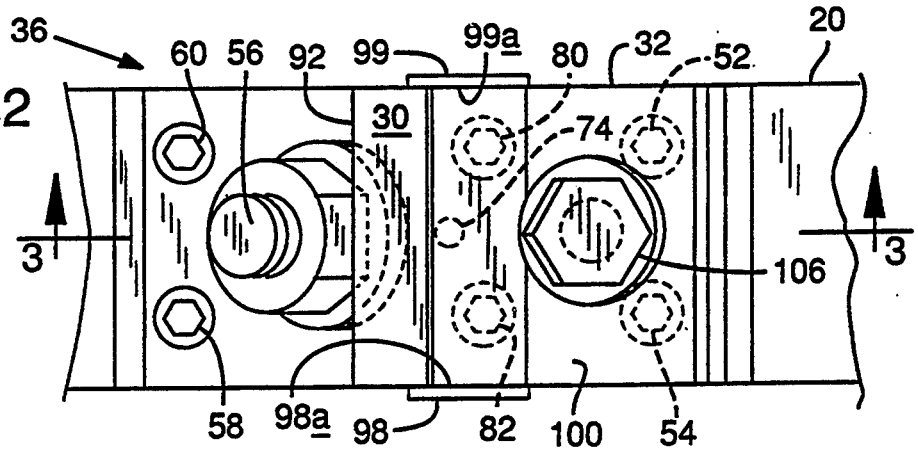
FIG. 2 is a view, on a somewhat enlarged scale, looking downwardly at a spindle segment in a cutter head.

Explaining now in greater detail support structure 36, shown at 32 is what is referred to as a block member. As illustrated in FIG. 2, such has substantially the width of the spindle segment. A forward or toe portion of the block member, given the reference number 32*a* overlays a forward portion 40*a* of the floor in pocket 26. A rear portion 32*b* of the block member lays against rear floor portion 40*b*. Joining the forward and rear portions of the block member is an intermediate portion 32*c* overlaying intermediate floor portion 40*c*.

The block member and held in place within the pocket by means of a number of fasteners exemplified, in the embodiment of the invention illustrated, by fasteners 52, 54 and 56. Fasteners 52, 54 securely hold rear portion 32*b* of the block member in place. Fastener 56 extends downwardly through intermediate portion 32*a* to secure the block member at a more forward location.

Adjustable abutment screws 58, 60 are screwed into forward portion 32*a* of the block member. Bottom extremities of these screws extend downwardly through the base of the block member to come up against floor portion 40*a* as demonstrated by screw 58 shown in FIG. 3. To raise the forward portion of the block member, the screws are advanced in portion 32*a* to protrude further from this portion of the block member. To lower the block member, the screws are turned in the opposite direction. Wherever the adjusted position of the screws, fasteners 56 and 52, 54 may be tightened firmly to secure the block member in the position selected.

A mounting insert member is shown at 70. An insert member mounts in a shelf recess 72 provided in an upper portion of the block member. The insert member has a length equal substantially to the width of the block member. The insert member is precisely positioned and held from any shifting along its axis or laterally of the block member by a pin 74 snugly received within cylindrical wells 76, 78 provided on the underside of the insert member and in the block member, respectively. Securing the insert member in its precisely located position are screw fasteners 80, 82. The top of the insert member is formed by key 84 and support surface 86.

Insert member 70 has a wear surface 79 that faces forwardly. The wear surface as viewed in FIG. 3 is cup-shaped. A chip on being cut from the wood being processed moves forwardly on the cutter head and across the wear surface thence to fall from the cutter head. With changing of the insert member, the wear surface may be replaced on being worn. Further, the shape of the wear surface may be changed with changing of the insert member, and with a differently configured wear surface, different sizes of chips are formed.

Knife or knife element 30 is a double-edge knife, and is mounted on the top of the mounting insert member. The knife has an edge 92 extending along each of its opposite side extremities. On the underside of the knife is a channel 96 that snugly receives key 84 of the mounting insert member. The mounting insert member includes shoulders 98, 99 extending upwardly from the level of surface 86 and the top of key 84 at opposite ends of the insert. Knife 30 has its end surfaces snugly against upstanding surfaces 99*a*, 98*a* of the shoulders. It should be apparent from this discussion that once the knife element is seated on the insert member with its opposite ends between the shoulder surfaces 98*a*, 99*a*, the knife element is positively locked by mechanical means for any axially displacement relative to the insert member that is underneath it or to the block member and cutter head body which provides support for the insert member. This is because of the presence of pin 74 and screws 80, 82 interposed between the insert member and block member 36, and the firm connection of the block member to the cutter head body by screws 52, 54, 56.

A knife clamp is shown at 100. Such has a forward toe portion 102 pressed against the back of the knife element. The rear of the knife clamp engages a shoulder 104 of block member 32. Securing the clamp tightly in place is a screw fastener 106.

When the cutter head is rotated, edge 92 of the knife is moved in a circular path shown at 108, with this path forming the outermost extremity of the cutter head when such is rotated. Normally this path is the same as the path of the other two knife elements supported by the spindle segment. Further, this path is disposed slightly radially outwardly of any movement path for parts in the cutter head other than the knife. It is obviously important that the precise position of the cutting edge be known and that it be slightly adjustable.

Earlier adjustable abutment screws 58, 60 were discussed which, on adjustment, produced a slight change in the position of block member 36 relative to the pocket that receives it. It will be seen that with adjustment of the screws to further extend them from the block member, this has the affect of raising the forward portion of the block member and moving the cutting edge 92 slightly outwardly. On the other hand, with the adjustment screws backed away from the position shown, this has the affect of lowering the forward portion of the block member with slight lowering of the position of edge 92 relative to the axis of the cutter head. Whatever the final adjusted position selected for the block member, fasteners 56 and 52, 54 may be tightened to secure the block member in place.

It is beneficial to have fasteners 56 and adjustment abutment screws 58, 60 exposed to the exterior of the cutter head through the pocket which receives the assembly described. This enables adjustments in the position of the block member to be made with the knife element held in place on the block member.

There has been described a cutter head which includes replaceable knife elements providing a cutting action in the cutter head. To turn a knife element or to replace it requires little down time. Once a proper position for a block member has been determined, normally the position remains unchanged when a knife is replaced or turned over to place a new cutting edge in operative position. A knife, when mounted in place, is securely held by mechanical interfitting structure providing for positive interlocking engagement of the knife element relative to the cutter head.

Figure 5:
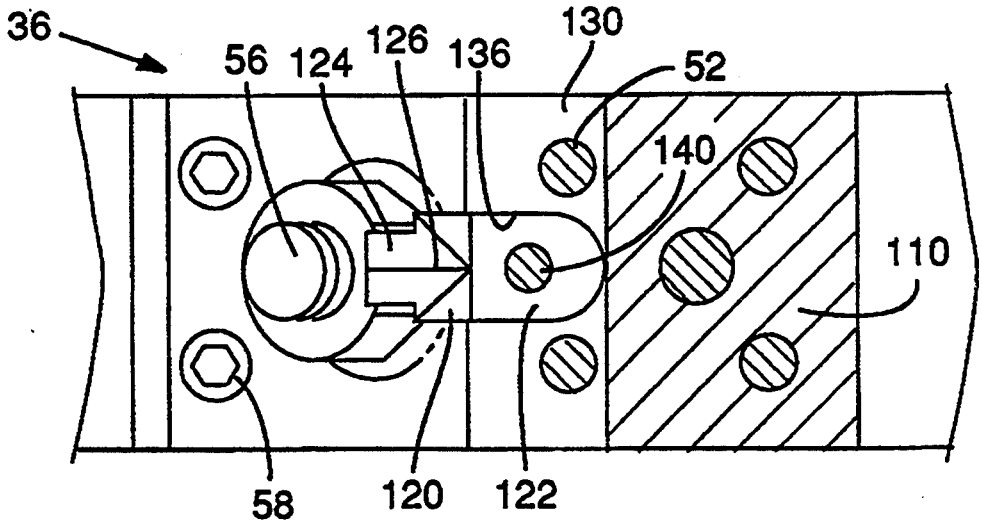
FIG. 5 is a view taken generally on the line 5—5 in FIG. 4.
Figure 4:
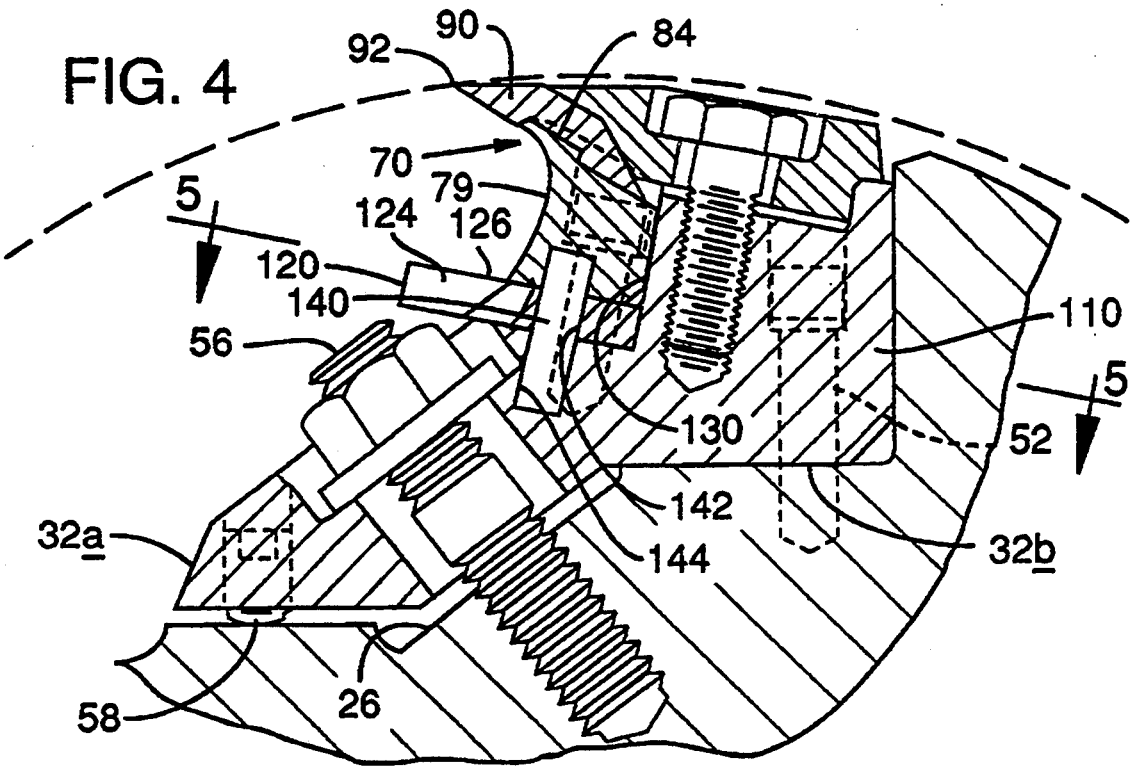
FIG. 4 is a cross sectional view, similar to FIG. 3, but illustration a modification of the invention.

Refer now to FIGS. 4 and 5, a block member 110 is shown seated in pocket 26 of the cutter head body. In most respects, the block member is similar to block member 32 earlier described. Thus, it includes forward and rear portions 32*a* 32*b* and is secured within the pocket utilizing fastener 56, fastener 52, and adjustment screw 58.

Doubel-edged knife 90 is clamped in place against a removable insert member 70. The member has a key 84 extending along the base of knife 90.

Insert member 70 has an outer surface or wear surface 79 which chip material moves over in the process of being cut from the log or other wood material being processed.

In the embodiment of the invention illustrated, the support structure for the knife further includes a splitter element, designated at 120, mounted on the block member in a position intermediate the block member and the insert member 70.

The splitter element, or splitter, has a base end 122, and an opposite end 124 which protrudes forwardly of the wear surface and the insert member and which has a splitter edge 126 extending along the top thereof. The splitter edge extends transversely of the exposed cutting edge in knife 90, shown at 92, and also transversely of the rotation axis of the cutter head body.

Shelf recess 130 receives the insert member. The base of this shelf recess has a groove or channel 136 extending therealong centered substantially midway between opposite sides of the block member. The channel snugly receives the base end of the splitter element.

Pin 140 has its upper end seated in the insert member. The pin extends downwardly from this upper end, through a bore 142 and the splitter element, and then into a bore 144 provided in the block member.

From the construction described, it should be understood that the splitter element is firmly held in place with the detachable mounting provided. The splitter element can be changed without changing the setting of block member 110, or the setting of the knife. The splitter element does not require any additional components, like fasteners for the purpose of holding it in place. The knife can be turned about, and replaced with another knife element, without changing the splitter element. The system is easily run, either with or without the splitter element, depending upon the type of wood being handled and the conditions of the cutting.

While an embodiment of the invention has been described, it should be obvious that modifications and variations are possible.

It is claimed and desired to secure by letters patent:

1. A chipping cutter head including a body and shaft extensions extending from opposite ends of the body, the shaft extensions having a common axis and providing for rotation of the cutter head about said axis, a pocket disposed in said body adjacent the periphery thereof and a knife disposed in said pocket with a cutting edge which substantially parallels said axis, support structure for the knife supporting the knife on said body, mechanical interfitting structure joining the knife to said support structure and said support structure to said body providing for positive interlocking engagement of the knife relative to the cutter head body preventing shifting of the knife in an axial direction relative to said body, and said interfitting structure including opposed shoulders engaging opposite ends of the knife, and a screw fastener extending from the support structure into the body and joining the support structure and body.

2. A chipping cutter head including a body and shaft extensions extending from opposite ends of the body, the shaft extensions having a common axis and providing for rotation of the cutter head about said axis, a pocket disposed in said body adjacent the periphery thereof and a knife disposed in said pocket with a cutting edge which substantially parallels said axis, support structure for the knife supporting the knife on said body, mechanical interfitting structure joining the knife to said support structure and said support structure to said body providing for positive interlocking engagement of the knife relative to the cutter head body and preventing shifting of the knife in an axial direction relative to said body, and said support structure including a block member seating within said pocket, a screw fastener securing the block member to said body, a detachable mounting insert member seated against the block member, a pin extending from the insert member to the block member to lock the insert member and block member from relative displacement, and shoulders on said insert member engaging opposite ends of said knife.

3. The chipping cutter head of claim 2, which further includes a splitter element having a base end and a cutting end, the base end seating between the block member and insert member, said cutting end having a splitter edge protruding forwardly of the insert member and transversely of said cutting edge.

4. The chipping cutter head of claim 2, wherein said block member includes a forward portion and a rear portion, said insert member is detachably secured to said rear portion of the block member, said screw fastener secures said rear portion of the block member to said body, said forward portion of the block member is exposed to the periphery of the body through said pocket, and which further includes adjustable means depending from said forward portion of the block member to said body producing an adjustable spacing between said forward portion of the block member and said body, said adjustable means being exposed to the periphery of said body through said pocket.

5. A chipping cutter head including a body and shaft extensions extending from opposite ends of the body having a common axis and providing for rotation of the cutter head about said axis;

a pocket in said body indented inwardly from the periphery of the body and said pocket having a floor;

a block member disposed in said pocket above said floor;

a replaceable double-edged knife detachably mounted on said block member with one edge of the knife exposed and in an operative cutting position situated beyond the periphery of said body, a fastener securing the block member to said body; and adjustable means interposed between the block member and said floor for adjusting the relative position between the two with adjustment of said adjustable means changing the position of said exposed edge of said double-edged knife.

6. The chipping cutter head of claim 5, wherein said block member includes a forward portion and a rear portion, and wherein said adjustable means is exposed to the periphery of said body and mounted on said forward portion of said block member.

7. The chipping cutter head of claim 5, wherein said block member includes a forward portion and a rear portion, the forward portion of the block member is exposed to the periphery of said body through said pocket, said fastener connects the rear portion of said block member and said body, and which further includes a second fastener connecting the forward portion of the block member to said body.

8. A chipping cutter head including a body and shaft extensions extending from opposite ends of the body having a common axis and providing for rotation of the cutter head about said axis, a pocket in said body indented inwardly from the periphery of the body, a block member seating within said pocket, a detachable mounting insert member seated against the block member, a splitter element having a base end and the base end of said splitter element seating intermediate said block and insert members, a replaceable double-edged knife supported on said insert member, a clamp clamping the knife in place, and a fastener system securing the clamp to the block member and the block member to said body.

9. The cutter head of claim 8 wherein one of said members has a channel extending therealong, said base end of the splitter element seats within said channel, and said splitter element has a forward end with a splitter edge extending generally transversely of said rotation axis.

10. A chipping cutter head including a body and shaft extensions extending from opposite ends of the body, the shaft extensions having a common axis and providing for rotation of the cutter head about said axis, a pocket disposed in said body adjacent the periphery thereof and a double-edged knife disposed in said pocket with one edge of the knife exposed in an operative position situated beyond the periphery of said body and said exposed edge substantially paralleling said axis, a block member disposed in said pocket secured to said body, an insert member detachably mounted on said block member, said knife being supported by said insert member and the insert member having an exterior surface facing the direction of travel of said cutter head, and a detachable splitter element detachably mounted adjacent said insert member, such splitter element having a splitter edge held in a position projecting forwardly of said surface of said insert member and extending in a direction which is transverse of said exposed edge of the knife element.

11. The cutter head of claim 10, wherein the splitter element is mounted in a position between the insert and block members, and is exposed with removal of the detachable insert member.

12. The cutter head of claim 11, wherein one of said members has a seating channel extending therealong and said splitter element is seated in said channel.

* * * * *